US006460612B1

(12) United States Patent
Sehmbey et al.

(10) Patent No.: US 6,460,612 B1
(45) Date of Patent: Oct. 8, 2002

(54) HEAT TRANSFER DEVICE WITH A SELF ADJUSTING WICK AND METHOD OF MANUFACTURING SAME

(75) Inventors: Maninder S. Sehmbey, Hoffman Estates, IL (US); James P. Chen, Schaumburg, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/074,284

(22) Filed: Feb. 12, 2002

(51) Int. Cl.[7] ..... F28F 27/00

(52) U.S. Cl. ..... 165/96; 165/104.26; 361/700; 257/715; 174/15.2

(58) Field of Search ..... 165/104.26, 96; 361/700; 431/325; 257/715, 714; 174/15.2

(56) References Cited

U.S. PATENT DOCUMENTS

| | | | | | |
|---|---|---|---|---|---|
| 3,730,674 | A | * | 5/1973 | Gross | 431/325 |
| 5,771,967 | A | * | 6/1998 | Hyman | 165/104.26 |
| 6,070,656 | A | * | 6/2000 | Dickey | 165/104.26 |
| 6,330,907 | B1 | * | 12/2001 | Ogushi et al. | 165/104.26 |

FOREIGN PATENT DOCUMENTS

| | | | | |
|---|---|---|---|---|
| JP | 8182085 | * | 10/1983 | 165/104.26 |
| JP | 1066086 | * | 4/1986 | 165/104.26 |
| JP | 2157595 | * | 6/1990 | 165/104.26 |
| JP | 3048895 | * | 9/1992 | 165/104.26 |
| JP | 5060479 | * | 3/1993 | 165/104.26 |
| SU | 1083063 | * | 7/1985 | 165/104.26 |

* cited by examiner

*Primary Examiner*—Christopher Atkinson
(74) *Attorney, Agent, or Firm*—Lalita P. Williams

(57) ABSTRACT

A heat pipe and method that utilizes a multi-layered shape memory alloy (SMA) as the wick structure. Each layer has a different transformation temperature. The inner layer of the SMA begins contracting first when heat is applied along the surface of the heat pipe. The contraction reduces the effective capillary radius $r_c$ of the wick, thereby maintaining or increasing the capillary pumping pressure and thus the ability to remove heat. As the temperature of the heat pipe continues to rise, the outer layer begins contracting to reduce the capillary radius further. As a result, the local pumping pressure is maintained or even increased to accommodate higher local heat flux and remove the heat to prevent "dry-out."

9 Claims, 2 Drawing Sheets

HEAT TRANSFER DEVICE WITH A SELF ADJUSTING WICK AND METHOD OF MANUFACTURING SAME

FIELD OF THE INVENTION

The present invention relates generally to the field of heat transfer devices and more particularly, to a heat transfer device with a self adjusting wick and a method of manufacturing same.

BACKGROUND OF THE INVENTION

A heat transfer device, generally called a "heat pipe", is a device that can efficiently transfer heat from one point to another. It is often referred to as a superconductor of heat because it possesses an extraordinary heat transfer capacity and rate with almost no temperature drop. A heat pipe typically consists of a sealed aluminum or copper container whose inner surfaces have a capillary wicking material. A heat pipe is based on the principle of closed loop evaporation/boiling and condensation of a fluid. The liquid inside the heat pipe evaporates and/or boils off the areas where heat is dissipated by electronic components (mounted externally to the heat pipe) and travels to the condensation space as vapor. The vapor spreads evenly in the condensation space and condenses back into liquid form by rejecting heat to the ambient. The condensed liquid travels back to the heated section by capillary action through the porous wick structure on the interior of the heat pipe. The quality and type of wick usually determines the performance of the heat pipe. Different types of wicks are chosen depending on the application for which the heat pipe is being used.

The wick structure of a traditional heat pipe remains constant throughout its operating temperature range. Thus, the porosity and pore size of the wick structure cannot be changed during operation. This inhibits the ability to adjust the capillary pressure according to temperature conditions along points within the heat pipe, which in turn, could result in local "dry-out" if a large local heat flux is presented at a point within the heat pipe. This dry-out condition could result in the total failure of the heat pipe. Some variable-wick heat pipes are known. In these heat pipes, a specific wick structure is tailored for the anticipated heat flux distribution. At locations where the highest heat fluxes are expected, the pore size is made small to increase the capillary force. The pore size in other locations is kept larger to allow low resistance to liquid flow. These heat pipes do not have the capability of adjusting the wick structure once the heat pipe is assembled. Thus, the usefulness of these known variable wick heat pipes is limited to the exact heat flux distribution and temperature that they were designed for.

Thus there is a need for an improved heat pipe wherein the capillary pressure of the wick can be adjusted post assembly to prevent dry-out and failure of the heat pipe.

DETAILED DESCRIPTION OF THE DRAWING

The preferred embodiment of the present invention provides a heat pipe and method that utilizes a multi-layer shape memory alloy (SMA) porous structure having different transformation temperatures for each layer to form a complete wick structure. Regardless of where the local "hot spot" is presented along the heat pipe, the innermost layer of the SMA begins contracting at the hot spot locally, thereby maximizing the capillary pressure. When the temperature at the hot spot increases beyond a certain temperature, the outer layer of the SMA begins contracting to further increase the capillary pressure. The porosity and pore size of the wick are therefore adjusted to accommodate the local operating conditions. As a result, the local pumping pressure is maintained or even increased to accommodate higher local heat flux and remove the heat to prevent "dry-out."

The capillary pumping pressure is an important consideration in designing a heat pipe. The capillary pumping pressure is a function of the relationship between the surface tension of the liquid ($\sigma$), the contact angle ($\theta$) between the liquid and the solid material, and the effective capillary radius ($r_c$). This relationship is defined in the equation below.

$$\Delta P_{c,M} = \frac{2\sigma\cos\theta}{r_c}$$

where $\sigma$≡surface tension=function(working fluid, temperature)

$\theta$≡contact angle=function(liquid/material interaction, surface roughness, and surface contamination)

$r_c$≡effective capillary radius=function(wick structure pore size) In the presence of a large local heat flux, a local temperature increase lowers the surface tension. As set forth in the equation above, a reduction in surface tension reduces the capillary pumping pressure. If the local heat load is large enough, the reduction in the capillary pumping pressure could result in an insufficient supply of working fluid. A dry-out could occur under this scenario.

Figure 1:
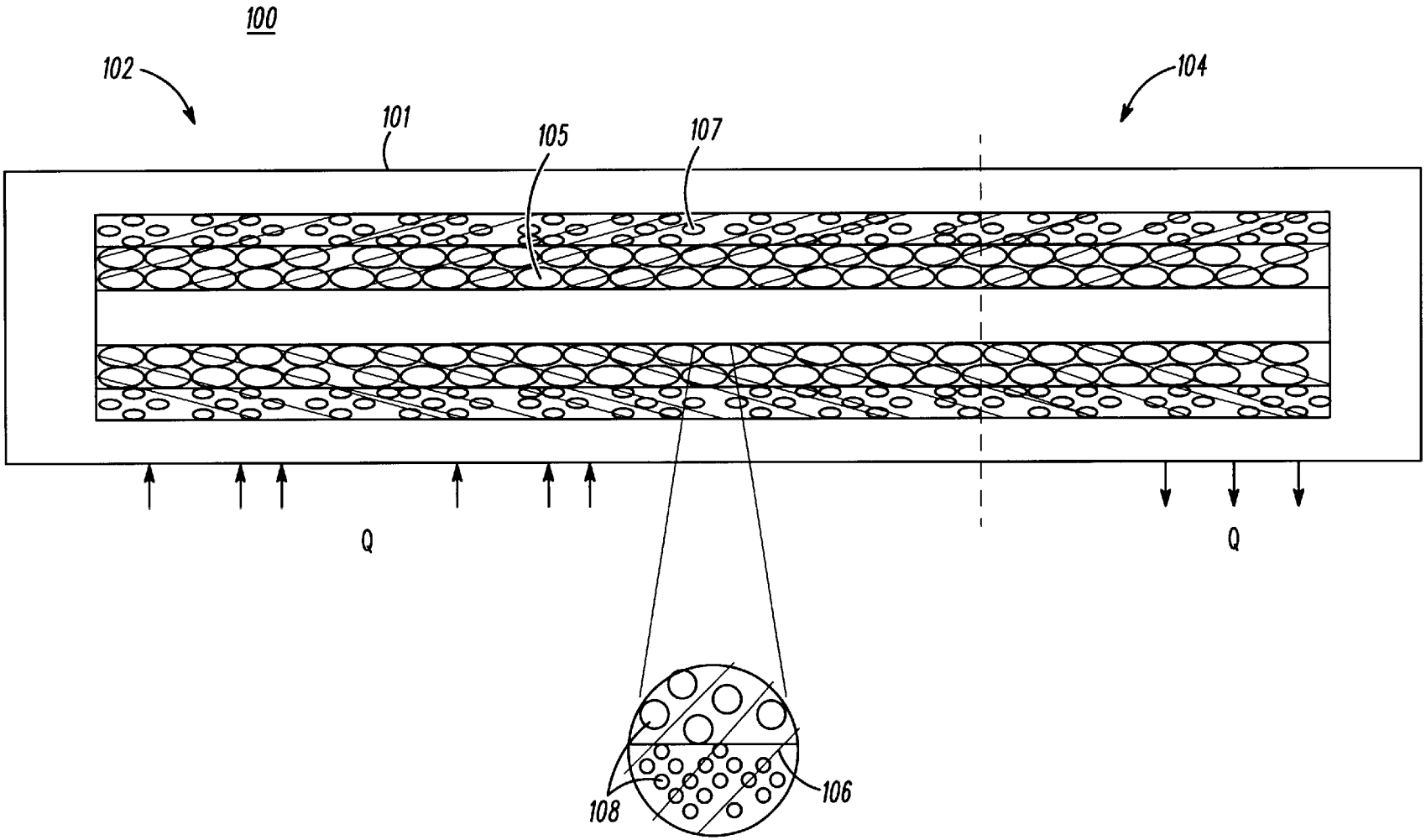
FIG. 1 is a partial cross section of a side view of a heat pipe in accordance with the preferred embodiment of the present invention.

Referring to FIG. 1, a partial cross section of a side view of a multi-layer SMA heat pipe 100 in accordance with the preferred embodiment of the present invention is shown. Preferably, the SMA is a nickel-titanium (NiTi) or copper-zinc aluminum (CuZnAl) alloy. Such alloys can be obtained from Shape Memory Application, Inc. of San Jose, Calif. The heat pipe includes an evaporator section 102 and a condenser section 104. A multi-layer wick structure including a plurality of capillaries 108 and a working fluid 106 is formed on an interior surface of the outer casing 101 of the heat pipe 100. As shown in FIG. 1, the multi-layer wick structure includes an inner layer 105 and an outer layer 107. The inner layer 105 has a transformation temperature lower than that of the outer layer 107. Preferably, the transformation temperature of the inner layer 105 is 60° C. and the transformation temperature of the outer layer 107 is 80° C.

Inside the heat pipe, the working fluid 106 enters the pores of the capillary material 108. When heat is applied along the surface of the heat pipe 100, the working fluid 106 begins to evaporate and enters a vapor state, thus picking up the latent heat of vaporization. The gas, which then has a higher pressure than the former liquid, moves inside the heat pipe 100 to a colder location, the condenser section 104, where it condenses. Thus, the gas gives up the latent heat of vaporization and moves heat from the input end (evaporator section 102) to the output end (condenser section 104) of the heat pipe 100.

In the heat pipe of the present invention, the inner layer 105 begins contracting at a particular location when heat is applied along the surface of the heat pipe and the temperature at that location exceeds a certain temperature, preferably 60° C. The contraction reduces the effective capillary radius $r_c$ of the wick, thereby maintaining or increasing the capillary pumping pressure and thus the ability to remove heat. If the temperature of the heat pipe at the particular location continues to rise due to excessive heat input, the inner layer 105 may eventually experience dry-out. However, in accordance with the preferred embodiment of the present invention, when the temperature at the particular location exceeds 80° C., the outer layer 107 begins contracting to reduce its capillary radius. This helps to prevent or delay the total dry-out at the particular location. Because each layer 105, 107 is thin, preferably on the order of 0.5 mm, multiple layers can be used to achieve a continuous temperature/heat flux dependent wick structure. For simplicity of explanation, only two layers are shown in FIG. 1.

Preferably, the heat pipe of the present invention is manufactured by flame spraying different SMA alloy combinations in layers on the inner surface of the heat pipe prior to final assembly. The heat pipe could also be manufactured by sintering packed SMA powder metal in layers on the inner surface of the heat pipe, or by packing multiple varying alloy SMA wire-screens or SMA fiber-wool layers on the inner surface of the heat pipe prior to final assembly.

Figure 2:
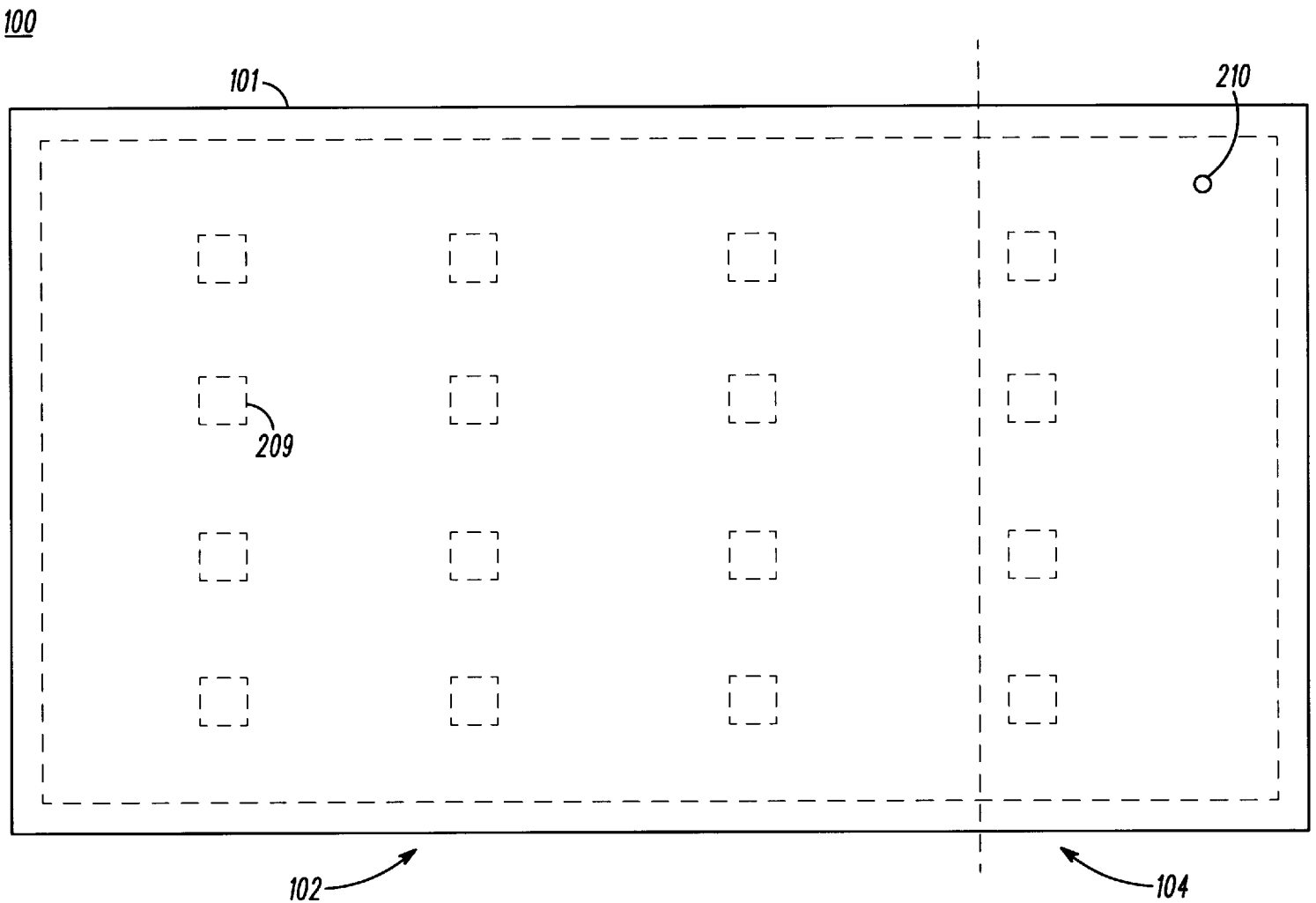
FIG. 2 is a top view of the heat pipe of FIG. 1 in accordance with the preferred embodiment of the present invention.

The preferred method of forming a flat plate heat pipe with layered SMA wick involves the following steps. Preferably, a 5 mm deep cavity is machined out of a 6 mm thick plate (main plate) of copper or titanium which measures approximately 200 mm×300 mm. The cavity is machined to leave a border of approximately 10 mm width around the outer periphery of the plate and to leave a plurality of bosses 209 (FIG. 2) that are used as structural elements in the flat plate heat pipe. A matching cover plate of 200 mm length, 300 mm width and 1 mm thickness is also prepared by machining. The main plate and cover plate as two parts form the outer casing 101 of the heat pipe.

The layered SMA wick is formed in the following manner. First, the outer layer 107 is formed on the interior of the cavity and one side of the cover plate by flame spraying a SMA alloy of composition specified to obtain a transition temperature of 80° C. For the outer layer 107, the particle size of the SMA alloy used in the flame spray process is approximately 120 micrometers. This particle size and the flame spray parameters are controlled to obtain a pore size of 40 micrometers and a thickness of approximately 0.5 mm for the outer layer 107. The inner layer 105 is then formed in a similar manner by flame spraying a SMA alloy of composition specified to obtain a transition temperature of 60° C. For the inner layer 105, the particle size of the SMA alloy used in the flame spray process is approximately 160 micrometers. This particle size and the flame spray parameters are controlled to obtain a pore size of 60 micrometers and a thickness of approximately 0.5 mm for the inner layer 105.

After the flame spray process is complete, the two parts of the casing 101 have a layered SMA wick disposed thereon. The two casing parts are assembled together and brazed to form a flat-plate sealed housing having a layered SMA wick on its interior surfaces. A small opening is created on one face of the housing 101 by drilling a hole of approximately 3 mm diameter. A 50–100 mm length tube of copper or titanium is welded onto this opening to create an evacuation and charging port 210 (FIG. 2) for the flat-plate heat pipe. The first step in creating the heat pipe is complete at this point. Subsequent steps are performed to set the different pore sizes of the layered wick at temperatures below and above the transition temperatures. These steps are described following the description of an alternative method for forming the layered wick in a tubular heat pipe.

The method of sintering packed SMA powder metal in layers on the inner surface of a tubular heat pipe involves the following steps. First, preferably a fixed length 100–300 mm length, of ¼ inch copper or titanium alloy tube is cleaned to remove greases, volatile materials and oxide layer. Next, a mandrel made of a high temperature material, such as graphite, is placed inside the tube co-axial with the internal surface of the tube. For the first step of the sintering process, the diameter of the mandrel is equal to the diameter of the inner surface of the outermost layer 107, preferably approximately 0.15 inch for the ¼ inch tube. For the outer layer 107 of the wick, the open space between the mandrel and the tube is packed with SMA particles with a mean size of approximately 100 micrometers (the SMA alloy composition is specified to obtain the 80° C. transition temperature). Next, the assembly is processed in a high temperature furnace maintained at a temperature just below the melting point of the SMA material, preferably 950° C. for the CuZnAl and 1250° C. for NiTi. The mandrel is removed after the first sintering process and the entire sintering process is repeated on the resulting tube with a smaller diameter mandrel, preferably 0.125 inch, to form the inner layer 105 using an SMA alloy with transition temperature of 60° C. and mean particle size of approximately 150 micrometers. The particle size can be varied to obtain the optimum pore size for the chosen heat pipe length. In the preferred embodiment, the particle sizes are specified to obtain pore sizes of 60 micrometers and 50 micrometers in the inner layer 105 and outer layer 107, respectively. A heat pipe tube with two wick layers is obtained after the second sintering process, which is preferably carried out at a temperature of 950° C. for the CuZnAl and 1250° C. for NiTi.

After the SMA layered wick heat pipe is obtained by either of the methods previously described, the entire heat pipe is heat treated at approximately 500° C. followed by fast quench in water to set the SMA shape. Once set, layers 105 and 107 of the SMA wick retain their shape, or pore sizes, at any temperature above their transition temperatures ( preferably 60° C. for the inner layer 105 and 80° C. for the outer layer 107). Layers 105 and 107 are flexible at temperatures below their transition temperatures. The SMA alloy in the heat pipe is then trained to maintain a different pore size at temperatures below the transition temperature. This different pore size is the pore size desired under normal conditions, i.e., when no hot spots are present. The training process is performed in the following manner. First, the wick layers 105, 107 are saturated with water by passing water through the heat pipe 100. The heat pipe 100 is then cooled to allow water to freeze and thereby expand the layered wick structure, which is in a flexible stage below its transition temperature. Next, the heat pipe is thawed to melt the ice and the cycle is repeated until the desired pore size at normal temperatures (less than the transition temperatures) is obtained. The desired pore size at normal temperatures is preferably 70 micrometers. The heat pipe is then heated above the maximum transition temperature, 80° C., at which point the SMA wick layers revert to their original pore sizes. The water saturation and freezing process is repeated again so that the SMA alloys attain two-way memory, i.e., the alloys attain different shapes (pore sizes in this case) below and above the transition temperature. The process described is referred to as the two-way training process in the shape memory alloy art. The heat pipe 100 with the trained SMA layered wick is then cleaned and charged with an appropriate fluid, preferably water, in a manner commonly known in the art.

The apparatus of the present invention is most useful in flat plate heat pipes where the location of hot spots can vary with application. However, the apparatus of the present invention is applicable to other types of heat pipes, e.g., a tubular heat pipe. While the invention may be susceptible to various modifications and alternative forms, a specific embodiment has been shown by way of example in the drawings and has been described in detail herein. However, it should be understood that the invention is not intended to be limited to the particular forms disclosed. Rather, the invention is to cover all modification, equivalents and alternatives falling within the spirit and scope of the invention as defined by the following appended claims.

What is claimed is:

1. A heat pipe comprising:

a casing having an interior surface that defines an interior region;

a wicking material disposed on the interior surface of the casing, the wicking material comprising:

an inner layer comprising a first shape memory alloy, wherein the first shape memory alloy has a first transformation temperature; and an outer layer comprising a second shape memory alloy, wherein the second shape memory alloy has a second transformation temperature greater than the first transformation temperature; and a fluid disposed in the interior region of the casing.

2. The heat pipe of claim 1 wherein the first transformation temperature is 60° C.

3. The heat pipe of claim 1 wherein the second transformation temperature is 80° C.

4. The heat pipe of claim 1 wherein the first and second shape memory alloys are nickel-titanium alloys.

5. The heat pipe of claim 1 wherein the first and second shape memory alloys are copper-zinc aluminum alloys.

6. The heat pipe of claim 1 wherein the inner layer begins contracting at a particular location when a temperature at the location exceeds a first predetermined temperature.

7. The heat pipe of claim 6 wherein the first predetermined temperature is 60° C.

8. The heat pipe of claim 6 wherein the outer layer begins contracting at the particular location when the temperature at the location exceeds a second predetermined temperature.

9. The heat pipe of claim 8 wherein the second predetermined temperature is 80° C.

* * * * *